United States Patent [19]

Beery

[11] 4,056,183

[45] Nov. 1, 1977

[54] RIBBONLESS ENDORSER HAVING A SHIFTABLE INKED PLATEN AND FEED ROLLER

[75] Inventor: Jack Beery, Farmington, Mich.

[73] Assignee: Burroughs Corporation, Detroit, Mich.

[21] Appl. No.: 684,449

[22] Filed: May 7, 1976

[51] Int. Cl.[2] ..... B41J 7/10

[52] U.S. Cl. ..... 197/1 R; 101/93.05; 101/310; 101/314; 101/324

[58] Field of Search ..... 197/1 R; 346/74, 48; 101/93.04, 93.05, 93.11, 93.48, 233, 235, 245, 250, 253, 279, 287, 288, 292, 324, 295, 297, 306, 310, 316–317, 322, 299

[56] References Cited

U.S. PATENT DOCUMENTS

| | | | |
|---|---|---|---|
| 3,340,984 | 9/1967 | Smith | 197/1 R |
| 3,869,986 | 3/1975 | Hubbard | 197/1 R |
| 3,918,567 | 11/1975 | Kittredge | 197/1 R |
| 3,922,965 | 12/1975 | Platt | 101/93.12 X |
| 3,982,622 | 9/1976 | Bellino et al. | 197/1 R |

*Primary Examiner*—Edward M. Coven
*Attorney, Agent, or Firm*—Robert J. Gaybrick; Richard Jordan; Kevin R. Peterson

[57] ABSTRACT

A printer unit for selectively printing on documents fed between a matrix printer and a rotatable inked platen. The platen is actuably movable between a retracted position and an advanced print position. The document while being printed upon is moved at the same speed as the velocity of the periphery of the rotating platen. The document feed is limited by a feed control roller cooperating with a pressure roller. The feed control roller is coaxial with the rotatable platen and is adapted to move therewith between the retracted position and the print position. A solenoid is provided to move the feed control roller and platen between the two positions. The documents are permitted to pass through the print station unimpeded when the roller platen and feed control roller are retracted.

16 Claims, 3 Drawing Figures

RIBBONLESS ENDORSER HAVING A SHIFTABLE INKED PLATEN AND FEED ROLLER

BACKGROUND OF THE INVENTION

1. Field of the Invention

The invention relates generally to the field of printers, and more specifically to selective dot matrix printers.

2. Description of the Prior Art

A printer employing the principles of the hereindisclosed invention forms a part of a ribbonless check endorser. Such an endorser, an example of which is described in U.S. Pat. application Ser. No. 650,707, filed Jan. 20, 1976 and assigned to the assignee of the present application, is used to print selected information such as a date, a code number or the like, onto a face (normally the rear face) of the check. Prior art devices have generally used an ink-bearing ribbon impressed between a print head and a document supported on a platen to effectuate printing. The use of the ribbon, however, necessitates the provision of a bulky ribbon drive and reverse mechanism, and the ribbon itself must be periodically changed, which can be a time-consuming operation. Other devices have included ink jet printers, the nozzles of which can become clogged and must be periodically cleaned, and the ink spray itself can have undesirable aspects.

The endorser disclosed in the above-referenced patent application Ser. No. 650,707, prints selective information onto the check by providing an inked rotatable cylindrical platen adapted to support the document, printing taking place on the face towards the platen. Ink is transferred to the document from the platen responsive to the impact. The documents travel through the printer when being printed upon at the same speed as the peripheral velocity of the rotating platen, the speed of the document past the print station being limited by a speed control roller cooperating with a pressure roller, with the documents being pinched therebetween. Because it is sometimes desired to avoid printing on a check, gaps are provided in the platen and the speed control roller to allow the documents to travel therepast without engaging the slower-rotating platen wheel. However, during printing the information to be printed on the document may be of sufficient length that the gap in the rotating platen is encountered. In such a case a gap also occurs in the printing on the document.

SUMMARY OF THE INVENTION

It is therefore an object of this invention to provide a print unit for selectively printing data onto documents such as bank checks or the like.

It is a further object of the invention to provide a matrix print unit utilizing an inked platen instead of a ribbon.

It is yet another object to provide a matrix print unit having an inked platen roller and a feed roller both movable between a retracted position and a print position.

It is yet another object to provide a matrix print unit utilizing an inked platen that permits gapless printing as the platen rotates.

The invention provides a matrix print unit having selectively actuable pins for impacting one face of a document and impressing the impacted portions onto a rotatable inked platen, the impacted portions being inked from the platen. The document while being printed travels through the printer at the same speed as the peripheral speed of the platen. The speed of the document is controlled by a feed roller in cooperation with a pressure roller, the former being coaxial with and rotating in unison with the platen. The feed roller and platen are shiftable as a unit between an advanced print position and a retracted position, the latter position permitting the document to move through the guideway unimpeded by the rollers and without printed upon.

BRIEF DESCRIPTION OF THE DRAWINGS

The aforementioned objects and features of this invention, as well as other objects and features, will be better understood upon consideration of the following detailed description when read in conjunction with the drawings, in which.

DETAILED DESCRIPTION OF THE PREFERRED EMBODIMENT

Figure 1:
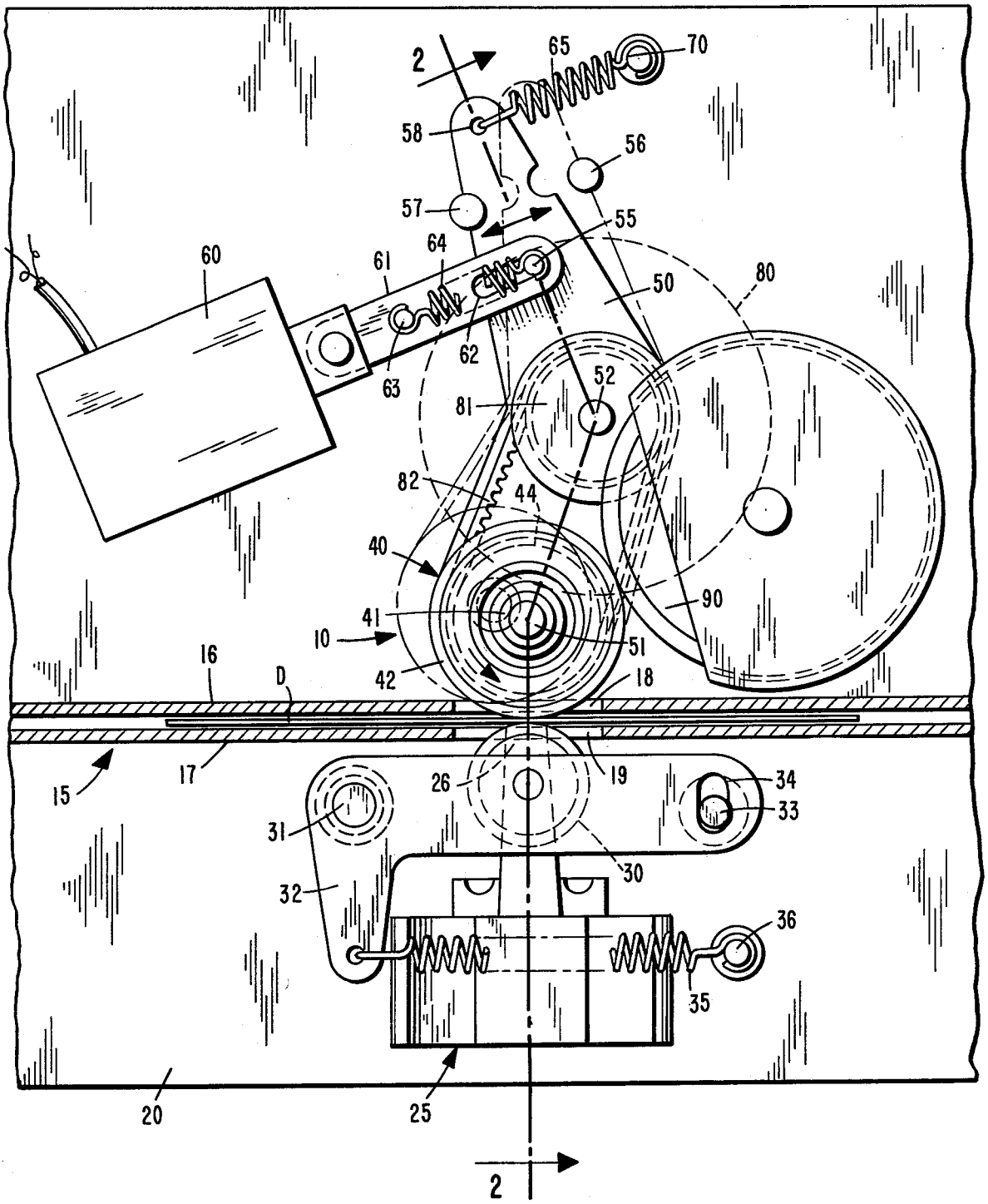
FIG. 1 is a top plan view of a document endorser employing the herein-disclosed invention.
Figure 2:
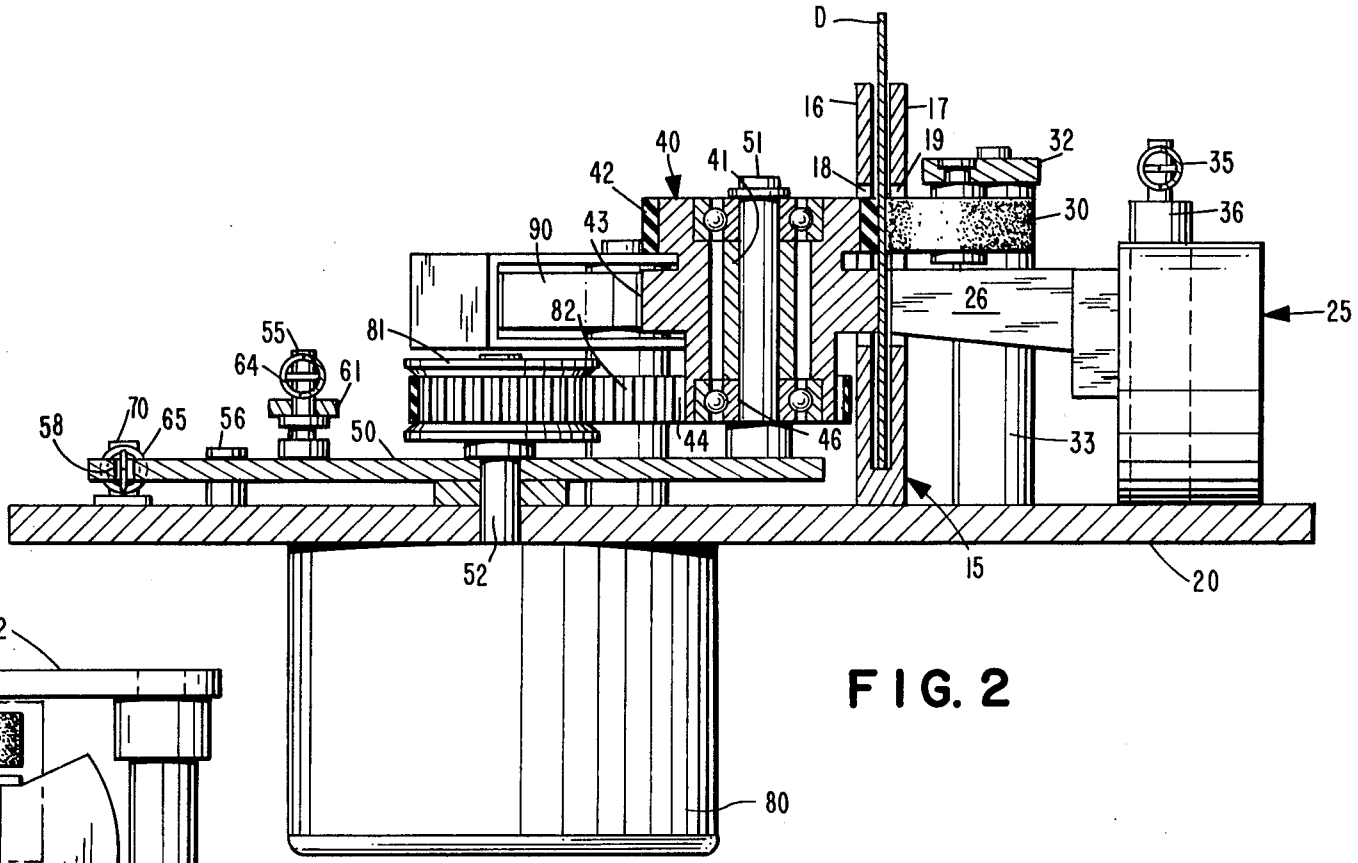
FIG. 2 is a section view of the document endorser taken along section line 2—2 of FIG. 1.

With reference to FIGS. 1 and 2, the invention provides a print unit generally designated as 10 for printing selective indicia onto a document D disposed in a document guideway 15. The embodiment described herein is particuarly useful as a check endorser; however, it is to be understood that the invention is not limited thereto.

The printer 10 provides baseplate 20 having disposed thereon document guideway 15 having walls 16 and 17, each wall having a slot 18 and 19 therein, slots 18 and 19 being continguous to each other. To one side of guideway 15 is a conventional dot matrix printer 25 having pin guideway 26 directed toward and positioned partially in slot 19 in wall 17. A pressure roller 30 is also positioned partially in slot 19, held above matrix printer 25 by support 31 and pressure roller arm 32. Arm 32 is rotatably joined to support 31, the extent of rotation being limited by forward limit stud 33 interposed in slot 34 in arm 31. A spring 35 connected between arm 32 and stud 36 is provided to maintain pressure roller 30 in its forwardmost position, that is, spring 35 forces pressure roller 30 toward and partially into slot 19.

Figure 3:
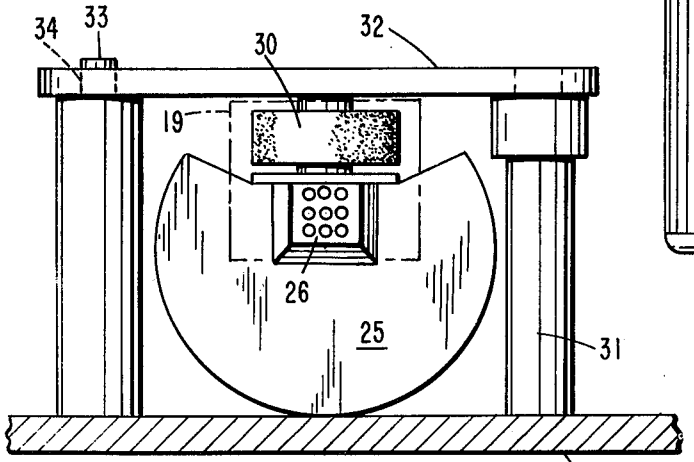
FIG. 3 is an end view of the document endorser showing the arrangement of the matrix printer, pressure roller and the support therefor.

A roller generally designated as 40 is provided on the other side of guideway 15 and includes three adjoining and mutually cooperating rollers on a common hub 41, having a hole 46 (FIG. 3) extending therethrough. Roller 40 includes feed roller 42 at the top, platen roller 43 in the center, and a drive roller 44 at the bottom. Drive roller 44 may comprise, for example, a flat pulley or a toothed positive drive belt pulley. It is preferable that drive roller 44 and platen roller 43 have hard surfaces and may be comprised of steel whereas feed roller 42 should have a resilient surface.

Pivot arm 50 is provided with stud 51 which cooperates with hole 46 in hub 41 and holds roller 40 with its axis vertical. Shiftable pivot arm 50 is pivoted at an intermediate pivot point 52, the amount of pivotal movement or shift being limited by studs 56 and 57, as shown in FIG. 2. At one extreme of pivotal movement, the advanced print position wherein arm 50 abuts stud 57, the top two rollers of roller unit 40, feed the roller 42 and inked plated roller 43, are partially interposed in guideway 15 through slot 18 in guideway wall 16. In this position, the feed roller 42 and pressure roller 30 are cooperably continguous to each other in guideway 15 and platen roller 43 and matrix printer 25 are in cooperable printing relationship with each other. At the other extreme of pivotal movement, the retracted position wherein arm 50 abuts stud 56, rollers 42 and 43 are completely out of slot 18 and guideway 15 and are no longer in the aforementioned relationships.

Solenoid 60 is provided to cause pivot arm 50 to shift between the two limiting studs 56 and 57. Solenoid 60 has an armature which is connected to arm 61. Arm 61 has a slot 62 formed therein and a stud 63 mounted thereon, arm 61 being in reciprocable relationship with stud 55 on pivot arm 50. Spring 64 is provided between studs 63 and 55, and spring 65 is provided between hole 58 in arm 50 and stud 70 on baseplate 20.

A conventional motor 80 is provided below baseplate 20, and connects to drive the belt drive gear 81, which also may comprise a flat pulley or a positive drive belt pulley. Belt 82 is provided to link gear 81 and drive roller 44.

A rotatable ink-bearing roller 90, provided to ink the surface of platen 43, is positioned so that platen 43 is in frictional contact therewith in the print position.

The operation will now be described. Preliminarily, motor 80 continuously drives gear 81 and belt 82, and thus roller unit 40 is continuously rotated at a constant preselected speed regardless of whether it is in the retracted position or the advanced print position. As described in the aforementioned patent application Ser. No. 650,707, documents individually travel laterally through guideway 15 at a rapid speed of, for example, 75 inches per second. When no printing is to occur on an individual document, solenoid 60 is maintained off thereby permitting spring 65 to force arm 50 to abut stud 56. In this position roller 40 is in its retracted position out of guideway 15, permitting the document to flow unimpeded through the guideway 15 past the print station. When a document is to be printed upon, solenoid 60 is actuated, which, by means of spring 64, causes arm 50 to pivot to abut stud 57 and position roller 40 in the print position interposed in guideway 15. Spring 64 between studs 63 and 55, and slot 62, are provided to permit solenoid 60 to seat completely. When the solenoid 60 is completely seated, spring 64 forces arm 50 to abut stud 57. The solenoid is controlled to shift roller 40 to the print position when a document to be printed upon is at the print station. When the roller unit 40 is in the print position, the document is pinched between feed roller 42 and pressure roller 30, and the speed of the document past the print station is limited by feed roller 42 to, for example, twelve inches per second. The particular speed is chosen to accommodate the printing speed of the pin printer. When the roller is shifted to the print position, platen roller 43 contacts ink roller 40 and is continuously inked thereby, all as above described.

During printing, selected pins of matrix printer 25 are impacted against the front face of the document which forces the impacted portions of the document to contact platen 43 and be inked thereby. When the printing on that document is completed, the solenoid 60 is deactivated and spring 65 returns arm 50 to abut pin 56, returning roller 40 it its retracted position. The document is then no longer restrained by feed roller 42 and is accelerated to the higher speed as it is removed from the printer through guideway 15.

It will occur to those skilled in the art that various modifications may be made in the above-described embodiment without departing from the spirit of the invention. It is expressly understood that the scope of the invention is not limited to the embodiment disclosed herein, but only as indicated in the appended claims.

What is claimed is:

1. Apparatus for selectively printing information onto documents moving past a print location comprising:

a. selectively actuable impact producing means;

b. rotatable impact receiving means shiftable between a retracted position and an advanced print position;

c. means for shiftably supporting said impact receiving means;

d. means for controlling the speed of said documents moved past the print location including (1) feed roller means supported by said shiftable supporting means, and (2) pressure roller means cooperable with said feed roller means to pinch the documents therebetween when said impact receiving means is in the advanced print position, said feed roller means and said impact receiving means being mounted for conjoint rotation on said shiftable supporting means; and e. means for shifting said shiftable supporting means, to shift said impact receiving means and said feed roller means between said retracted position and said advanced print position.

2. Apparatus as defined in claim 1 in which said impact receiving means comprises an inked platen.

3. Apparatus as defined in claim 2 further comprising roller means at said print location for coating said platen with ink when said platen is in said advanced print position.

4. Apparatus as defined in claim 2 in which said platen and said feed roller means are coaxially supported on said shiftable supporting means.

5. Apparatus as defined in claim 1 in which said supporting means comprises a pivoted arm.

6. Apparatus as defined in claim 1 further comprising means for conjointly rotating said impact receiving means and said feed roller means.

7. Apparatus as defined in claim 1 in which said impact producing means comprises a selectively actuable dot matrix printer.

8. Apparatus as defined in claim 1 in which said shifting means includes a solenoid having an armature.

9. Apparatus as defined in claim 8 in which said shiftably supporting means includes an elongated, intermediately-pivoted member having a first end and a second end, the solenoid armature being connected near said first end.

10. Apparatus as defined in claim 9 in which said impact receiving means and said feed roller are coaxially supported on said second end.

11. Apparatus as defined in claim 9 further including means for restricting the shiftable movement of said shiftable supporting means.

12. Apparatus as defined in claim 9 in which said first end includes a stud and said armature has a slot, said stud being disposed in said slot for limited reciprocable movement therein.

13. Apparatus for selectively printing information onto documents such as bank checks or the like moving past a print location comprising:

a. impact producing means including a selectively actuable dot matrix printer;

b. a rotatable inked platen shiftable between a retracted position and an advanced print position;

c. a feed roller shiftable with said platen and rotatable conjointly therewith;

d. a pressure roller cooperable with said feed roller for controlling the speed of the documents past the print location when said platen is in said advanced print position;

e. means for rotating said platen and said feed roller at a preselected speed; and f. means for shifting said platen and said feed roller.

14. Apparatus as defined in claim 13 in which said platen and said feed roller are coaxially disposed.

15. Apparatus as defined in claim 13 further including roller means at said print location for coating said platen with ink when said platen is in the advanced print position.

16. Apparatus for selectively printing information onto a moving document comprising:

dot matrix printer means having selectively actuable pins for impacting one face of the document, said pins being selectable to form a preselected character;

rotatable inked impact receiving means for supporting the other face of the document, said impact receiving means transferring ink to the document as said document is struck; and means for moving said document past said printer, said document moving means including:

a. a feed roller; and b. a pressure roller cooperable with said feed roller for pinching documents therebetween for continuously moving the document past said printer, said feed roller disposed coaxially with said rotatable impact receiving means and rotatable conjointly therewith.

* * * * *